United States Patent [19]

Tan et al.

[11] Patent Number: 4,957,102

[45] Date of Patent: Sep. 18, 1990

[54] LUMBAR SUPPORT DEVICE

[75] Inventors: Kenichi Tan; Shoji Mizuno, both of Ayase, Japan

[73] Assignee: Ikeda Bussan Co., Ltd., Ayase, Japan

[21] Appl. No.: 249,667

[22] Filed: Sep. 27, 1988

[30] Foreign Application Priority Data

Sep. 30, 1987 [JP] Japan ..... 62-148103[U]

[51] Int. Cl.[5] ..... A61F 5/00

[52] U.S. Cl. ..... 128/68; 297/DIG. 3; 128/66; 128/33; 128/44

[58] Field of Search ..... 128/66, 33, 64, DIG. 20, 128/24 R, 34, 68, 24.2, 24.3; 5/449, 432; 297/455, 456, DIG. 3, DIG. 8

[56] References Cited

U.S. PATENT DOCUMENTS

| | | | |
|---|---|---|---|
| 3,276,048 | 10/1966 | Beckman | 297/DIG. 8 |
| 3,392,723 | 7/1968 | Calvin | 128/33 |
| 3,915,421 | 10/1975 | Le Forestier | 297/DIG. 3 |
| 3,954,245 | 5/1976 | Costin | 297/DIG. 3 |
| 4,287,620 | 9/1981 | Zur | 5/465 |
| 4,321,044 | 3/1982 | Kron | 297/DIG. 8 |
| 4,576,149 | 3/1986 | Otuka et al. | 128/44 X |
| 4,615,336 | 10/1986 | Fijimoto | 128/44 X |
| 4,629,253 | 12/1986 | Williams | 297/DIG. 3 |
| 4,707,027 | 11/1987 | Horvath et al. | 297/DIG. 3 |
| 4,720,146 | 1/1988 | Mawbey et al. | 297/DIG. 3 |
| 4,775,185 | 10/1988 | Scholin et al. | 297/DIG. 3 |
| 4,778,216 | 10/1988 | Stupakis | 297/DIG. 3 |
| 4,827,546 | 5/1989 | Cvetkovic | 5/449 |

FOREIGN PATENT DOCUMENTS

| | | | |
|---|---|---|---|
| 497193 | 10/1953 | Canada | 297/456 |
| 59-2253 | 1/1984 | Japan . | |

*Primary Examiner*—Richard J. Apley
*Assistant Examiner*—Rachel Healey
*Attorney, Agent, or Firm*—Foley & Lardner, Schwartz, Jeffery, Schwaab, Mack, Blumenthal & Evans

[57] ABSTRACT

A lumbar frame is arranged, movable up and down, in a lower frame through second air mats which is attached to the seat back frame of a seat to correspond to the lumbar of a person who is seated on the seat, support brackets are attached, movable forward and backward, to both ends of the lumbar frame through link mechanisms and first air mats, a lumbar support member such as the zigzag or wave-formed spring is stretched between the support brackets, and an air supply and discharge means is used to supply and discharge air to and from the air mats to adjust the lumbar support member upward, downward, forward and backward.

5 Claims, 5 Drawing Sheets

LUMBAR SUPPORT DEVICE

BACKGROUND OF THE INVENTION

1 Field of the Invention

The present invention relates to a lumbar support device arranged in the seat back of a seat within a car, for example, to support the lumbars of an occupant.

2. Prior Art

The lumbar support device disclosed in preliminarily-opened Japanese Utility Model Disclosure No. 59-2253 is well known as the conventional one which uses particularly the air mat.

An example of this lumbar support device which uses the air mat will be described with reference to FIG. 1. Numeral 1 represents a seat back and the lumbar support device comprises zigzag springs 2 and pads 3 housed in the seat back 1 and three air mats 4 arranged vertically between the zigzag springs 2 and the pads 3. Air is selectively supplied to all, one or two of the three air mats 4 to adjust the position and pressure for supporting the lumbar of an occupant on the seat.

When the position and pressure for supporting the lumbars of the person are adjusted directly by the air mats 4, however, fine adjustment cannot be attained and as the result, the person cannot adjust the position and pressure so satisfactorily as he desires.

SUMMARY OF THE INVENTION

A lumber support device according to the present invention comprises a support member for supporting the lumbars of a person sitting on the seat, two support brackets for supporting the support member at both ends thereof, a lumbar frame for freely flexibly supporting these two support brackets through a link mechanism, a lower frame fixed to the side frame of a seat back to support the lumbar frame which is movable vertically first air mats each interposed between the lumbar frame and each of the two support brackets, second air mats each interposed between the lower frame and the lumbar frame, and an air supply and discharge means connected to the first and second air mats.

When the pressure for supporting the lumbar of a seated person is to be adjusted, air is supplied to or discharged from the first air mats to move the support member, which is supported between the lumbar frame and each of the two support brackets, forward and backward. When the position for supporting the lumbar of the seated person is to be adjusted, air is supplied to or discharged from the second air mats to move the lumbar frame, which supports the support member, up and down relative to the lower frame. When the support member is moved forward or backward and up or down in this manner by means of the first and second air mats, lumbar support effect can be easily attained as exact as the seated person desires.

An object of the present invention is therefore to provide an improved lumbar support device which uses the air mats.

Another object of the present invention is to provide a lumbar support device capable of easily and reliably attaining such a lumbar support effect as an occupant desires.

These and other objects as well as merits of the present invention will become apparent from the following detailed description with reference to the accompanying drawings.

DETAILED DESCRIPTION OF THE PREFERRED EMBODIMENT

Figure 1:
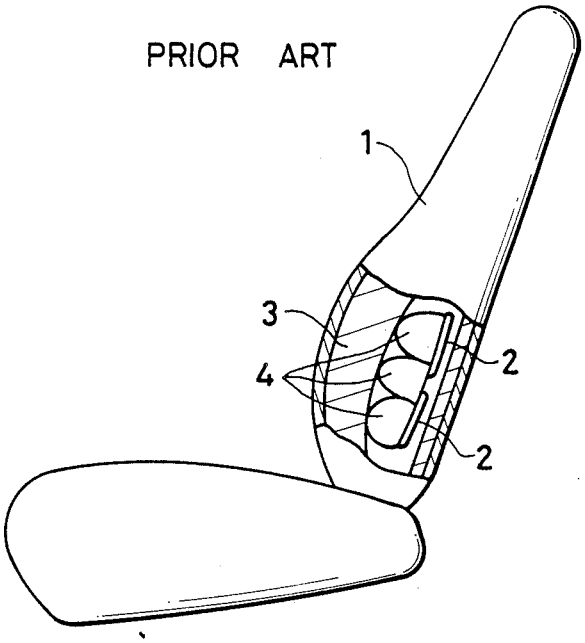
FIG. 1 PRIOR ART
FIG. 1 is a side view showing a car seat partly sectioned and in which an example of the conventional lumbar support device provided with air mats is arranged.
Figure 2:
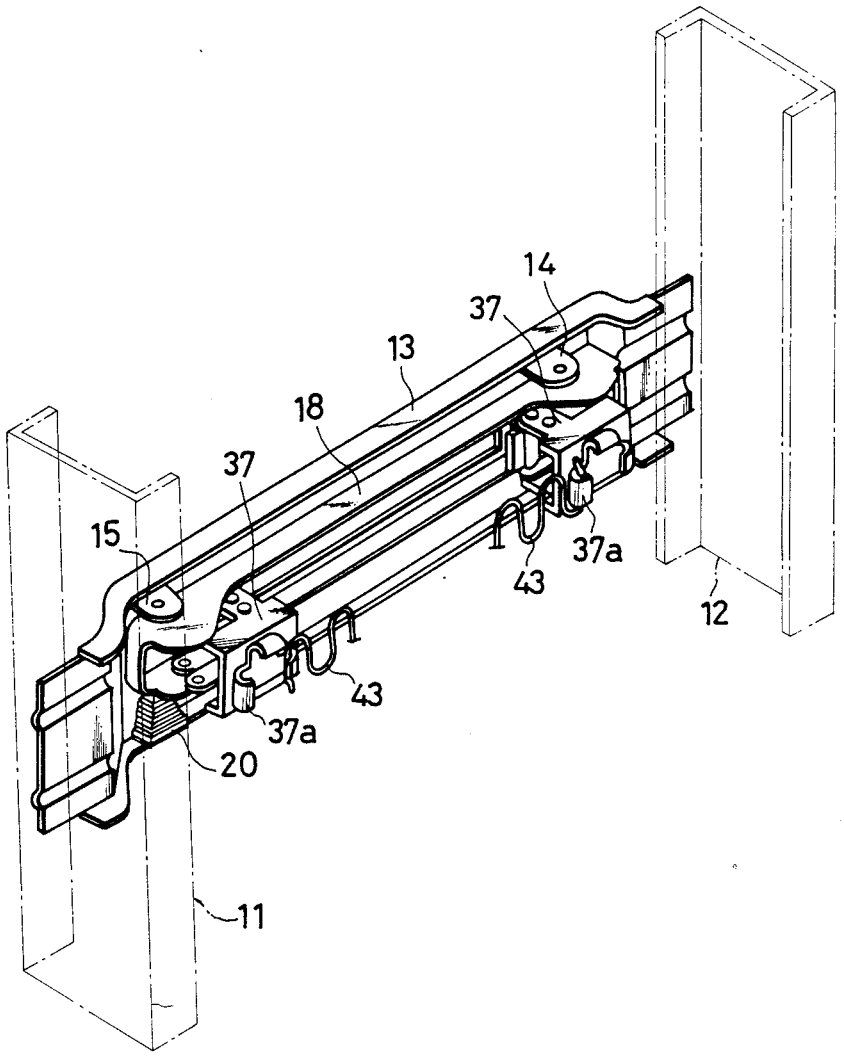
FIG. 2 is a perspective view showing a lumbar support device according to the present invention.
Figure 3:
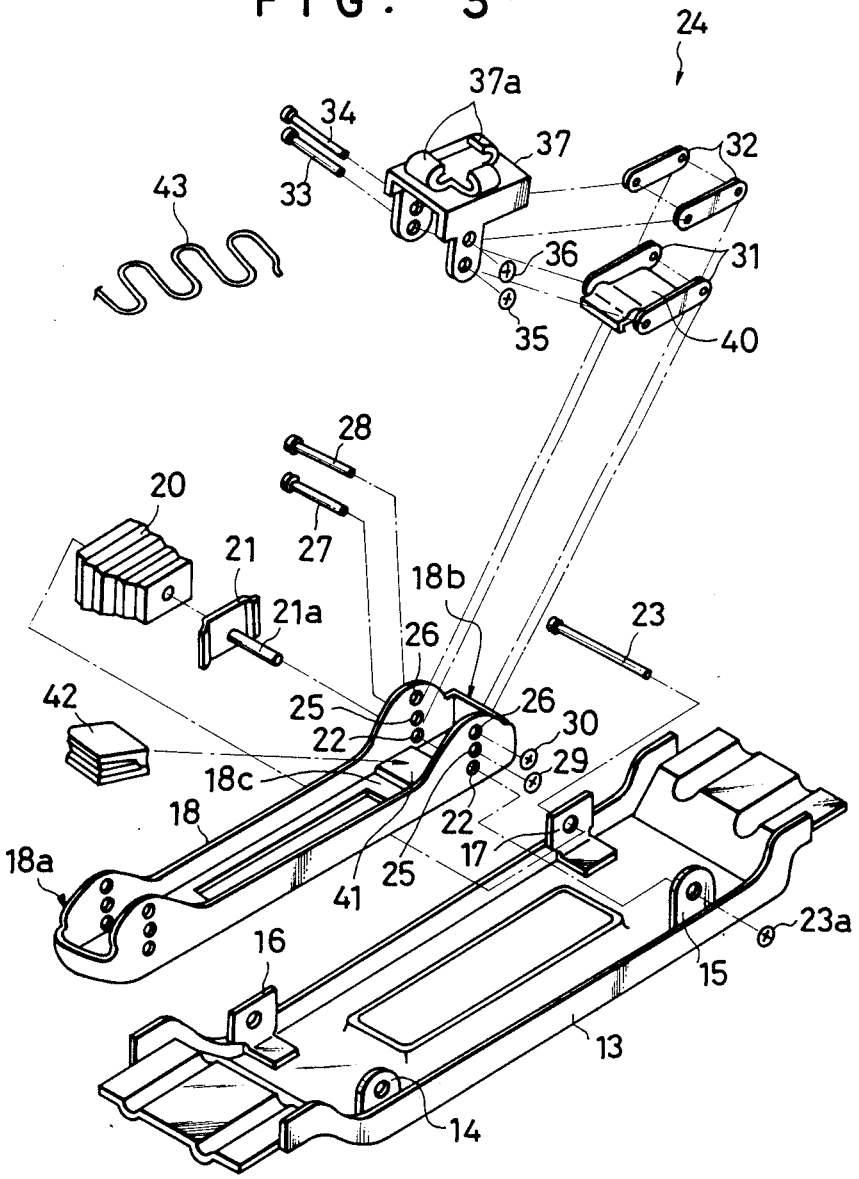
FIG. 3 is a perspective view showing the lumbar support device in FIG. 3 dismantled.

In FIG. 2, numerals 11 and 12 represent vertical side frames for a seat back of a seat and a lower frame 13 bridges the side frames 11 and 12 horizontally to support the lumbars of an occupant on the seat. As shown in FIG. 3 (where the lower and right side represents the upper side of the device), four ear pieces 14, 15, 16 and 17 are located adjacent to both ends of the lower frame 13 and at upper and lower sides thereof and a lumbar frame 18 having a section of fallen U-shape is horizontally arranged in the lower frame 13, keeping its both semi-circularly swelled ends 18*a* and 18*b* interposed between the ear pieces 14 and 16 and between the ear pieces 15 and 17, respectively. Second air mats 20 are interposed between the one end 18*a* and the ear piece 16 and between the other end 18*b* and the ear piece 17, respectively.

A receiving plate 21 provided with a guide pipe 21*a* is arranged between the second air mat 20 and the lumbar frame 18, inserting its guide pipe 21*a* through holes 22 provided at the end 18*b* of the lumbar frame 18. A pin 23 is further passed through the ear piece 17, air mat 20, guide pipe 21*a* and ear piece 15 in this order and then fixed by a push nut 23*a*. The lumbar frame 18 is thus supported, movable up and down, in the lower frame 13.

A pair of link mechanisms 24 is provided at each end 18*a*, 18*b* of the lumbar frame 18. Each link mechanism 24 comprises first and second links 31 and 32 which are parallel links and whose one ends are pivoted on pins 27 and 28 passed through holes 25 and 26 at one end 18*b* of the lumbar frame 18 and fixed by push nuts 29 and 30, and a support bracket 37 attached to the other ends of the first and second links 31 and 32 by means of pins 33, 34 and bush nuts 35, 36.

A receiving plate 40 is attached to the other end of the first link 31 and a first air mat 42 is interposed between the receiving plate 40 and another receiving plate 41 fixed on a bottom plate 18*c* at one end 18*b* of the lumbar frame 18.

The above arrangement is similarly provided at the other end 18*a* of the lumbars frame 18.

A zigzag or wave-formed spring 43 which serves as the support member for supporting the lumbar of an occupant on the seat is stretched between support claws 37a on the support brackets 37 attached to both ends 18a and 18b of the lumbar frame 18.

Figure 4:
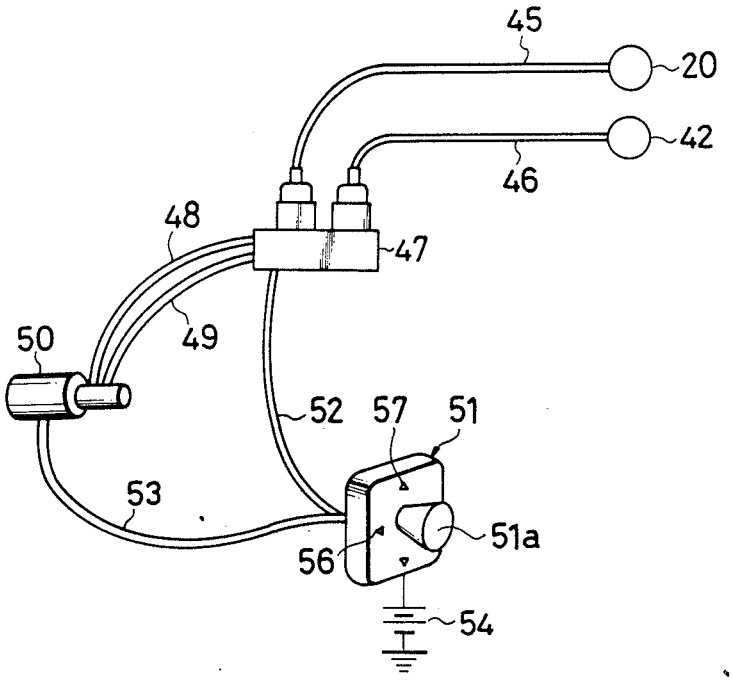
FIG. 4 shows an air support and discharge means employed in the lumbar support device of the present invention.

The second and first air mats 20 and 42 for controlling the up and down movement and forward and backward movement of the lumbar support member are connected to a dual solenoid valve 47 which is formed as a unit provided with two 2-port, 3-position solenoid valves which can be operated independently from each other and each of which has a neutral position, through air hoses 45 and 40. The dual solenoid valve 47 is connected to an air pump 50 through other air hoses 48 and 49, as shown in FIG. 4. The dual solenoid valve 47 and the air pump 50 are connected to a control switch 51 through harnesses 52 and 53 while the switch 51 is connected to a power source 54. An air supply and discharge means is thus formed.

Figure 5:
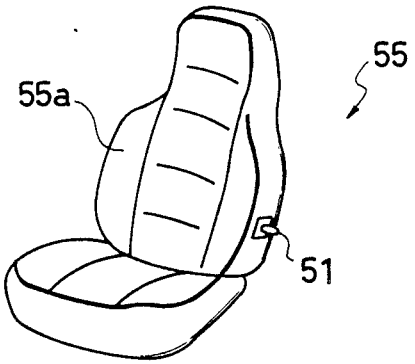
FIG. 5 is a perspective view showing a car seat provided with the lumbar support device of the present invention.

The control switch 51 is provided with a lever 51a which can be swung in four directions, that is, up, down, forward and backward. When the lever 51a is swung upward, for example, the air pump 50 is rendered operative and one part of the dual solenoid valve 47 causes the air hose 45 to be communicated with the air pump 50 through the air hose 48 to supply air into the second air mats 20. When the lever 51a is swung downward, the air pump 50 is stopped and air is discharged from the air mats 20. When the lever 51a is returned to neutral position, air supply and discharge are stopped. The dual solenoid valve 47 is controlled and the air pump 50 is rendered operative, as described above, in response to the lever 51a operation. The control switch 51 is located on one side of a seat back 55a of a car seat 55, as shown in FIG. 5. In the case of the lumbar support device having the above-described arrangement, its components are made operative as follows by the control switch 51.

Figure 6:
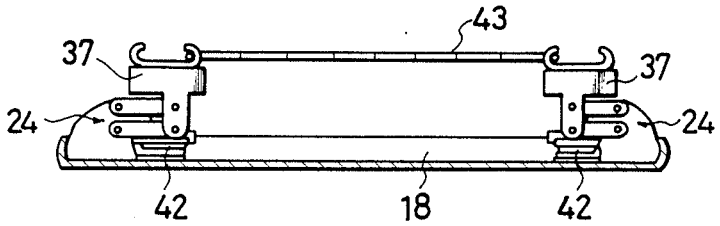
FIGS. 6 and 7 are explanatory views showing link mechanisms and first air mats operated in the lumbar support device according to the present invention.
Figure 7:
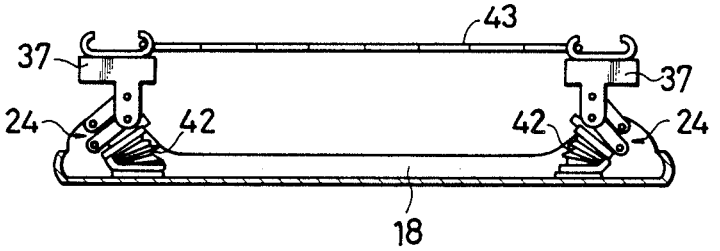

When the lever 51a of the control switch 51 is swung forward (or in a direction shown by an arrow 56 in FIG. 4), the air pump 50 is made operative while one of the dual solenoid valve 47 is controlled to cause the air hose 46 to be communicated with the air pump 50 through the air hose 49, so that air can be supplied to the first air mats 42. The link mechanisms 24 are thus erected to push the corrugated spring 43 stretched between the support brackets 37 from the spring position shown in FIG. 6 to the spring position shown in FIG. 7 so as to support the lumbars of the seated person.

When the lever 51a of the control switch 51 is swung backward (or in a direction reverse to the direction shown by the arrow 56), the air pump 50 is kept inoperative while one of the dual solenoid valve 47 is controlled to cause the first air mats 42 to be communicated with the outside to discharge air from the first air mats 42. The link mechanisms 24 are then folded by the weight of the seated person and the flexibility of pads in the seat back and of the surface skin for the seat back, causing the spring 43 to be returned to the spring position shown in FIG. 6.

Figure 8:
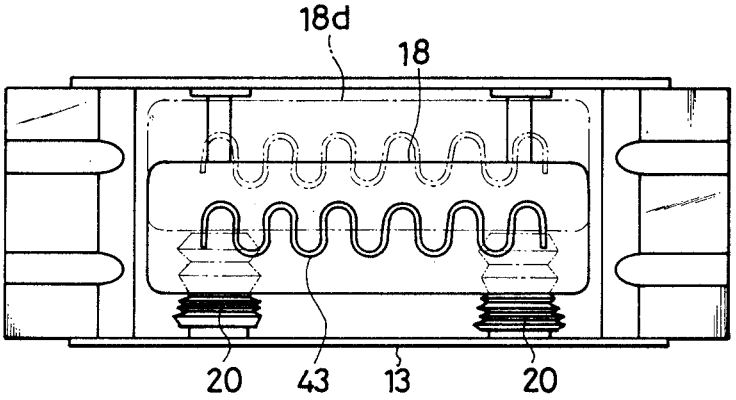
FIG. 8 is a front view showing a lumbar frame and second air mats operated in the lumbar support device according to the present invention.

When the lever 51a of the switch 51 is swung upward (or in a direction shown by an arrow 57 in FIG. 4), the air pump 50 is made operative while the other of the dual solenoid valve 47 is controlled to cause the air hose 45 to be communicated with the air pump 50 through the air hose 48 so as to supply air to the second air mats 20. The lumbar frame 18 is thus lifted to a position shown by a broken line 18d by means of the air mats 20 causing the zigzag spring 43 to be moved upward, as shown in FIG. 8.

When the lever 51a of the switch 51 is swung in a direction reverse to the direction shown by the arrow 57, the air pump 50 is kept inoperative while the other of the dual solenoid valve 47 is controlled to cause the second air mats 20 to be communicated with the outside to discharge air from the second air mats 20. The lumbar frame 18 comes down due to its own weight.. Springs may be used to lower the frame 18 instead of using the weight of the frame 18.

When the lever 51a of the control switch 51 is returned to neutral position, the device which was adjusted till then can keep its adjusted state. When the switch 51 is controlled and operated as described above, therefore, the zigzag spring 43 for supporting the lumbars of the seated person can be freely moved upward, downward, forward and backward. The person who is seated on the seat in the car can thus gain his lumbar support effect as easy and reliable as he can desire.

Pantographs can be used as the link mechanisms 24 and when they are extended, their foremost ends do not shift in the horizontal direction but move in the vertical direction. Therefore, a rod, plate or the like can be used as the support member in addition to the zigzag spring 43.

It may be arranged that plural zigzag springs are vertically stretched in the seat back frame and that they are pushed by the support member.

Although the present invention has been described referring to its preferred embodiment, it should be understood that various changes and modifications can be made without departing from the spirit and scope of the present invention.

We claim:

1. A lumbar support device within a seat back comprising:

a pair of vertical side frames;

a horizontal lower frame fixed at said side frames at the position of the lumbars of an occupant;

a horizontal lumbar frame including two ends vertically movably supported by the horizontal lower frame;

a pair of support brackets each one forwardly and rearwardly movably supported by one of said ends of said horizontal lumbar frame via a pair of link mechanisms;

a support member fixed to said brackets to support the lumbars of the occupant;

a first pair of air mats each one interposed between the lumbar frame and one of the support brackets;

a second pair of air mats each one interposed between the lower frame and one of the ends of said lumbar frame; and an air supply and discharge means connected to the first air mats to forwardly and rearwardly move the bracket, and connected to the second air mats to vertically move the horizontal lumbar frame.

2. A lumbar support device according to claim 1 wherein said support member is a zigzag or wave-formed spring.

3. A lumbar support device according to claim 1, wherein each of said link mechanisms includes first and second parallel links, each one comprising first and second ends; each of said first ends being pivotally attached to the lumbar frame and each of said second ends being pivotally attached to one of the respective support brackets.

4. A lumbar support device according to claim 1, further comprising a four-directional switch for actuating said air supply and discharge means so that the support brackets move forwardly and rearwardly and the horizontal lumbar frame moves vertically.

5. A lumbar support device according to claim 4, wherein said air supply and discharge means includes an air pump and a dual solenoid valve device, eahc comprising a two-port and three-position solenoid valve device controlled by the four-directional switch.

* * * * *